US007713358B2

(12) United States Patent
Pardini

(10) Patent No.: US 7,713,358 B2
(45) Date of Patent: May 11, 2010

(54) DISHWASHING MACHINE WITH A GRADUAL-START WASH CYCLE

(75) Inventor: Gianluca Pardini, Lucca (IT)

(73) Assignee: Premark FEG L.L.C., Wilmington, DE (US)

( * ) Notice: Subject to any disclaimer, the term of this patent is extended or adjusted under 35 U.S.C. 154(b) by 837 days.

(21) Appl. No.: 11/496,955

(22) Filed: Aug. 1, 2006

(65) Prior Publication Data

US 2007/0028948 A1 Feb. 8, 2007

(30) Foreign Application Priority Data

Aug. 2, 2005 (IT) ..... TO2005A0544

(51) Int. Cl.
*B08B 9/20* (2006.01)

(52) U.S. Cl. ..... 134/25.2; 134/56 D; 134/102.1; 134/103.1; 134/198

(58) Field of Classification Search ..... 134/103.1
See application file for complete search history.

(56) References Cited

U.S. PATENT DOCUMENTS 3,702,680 A * 11/1972 Woehler ..... 239/256
4,182,351 A * 1/1980 Deaton et al. ..... 134/58 D

FOREIGN PATENT DOCUMENTS

JP 10 225416 8/1998

OTHER PUBLICATIONS

Machine Translation of Tokunaga et al. JP 10-225416, Aug.1998.*
EP Partial Search Report, Dated Jun. 9, 2007; APP #061182465; 4 Pgs.

* cited by examiner

*Primary Examiner*—Michael Barr
*Assistant Examiner*—David Cormier
(74) *Attorney, Agent, or Firm*—Thompson Hine LLP

(57) ABSTRACT

A dishwashing machine comprising a washing station having a wash water tank, a plurality of wash water dispensing nozzles, a recirculation pump adapted to circulate the wash water from the tank to the nozzles; and a hydraulic filling container communicating with the recirculation pump via a first and a second conduit respectively connected to a delivery conduit and to a suction conduit of the pump itself.

10 Claims, 1 Drawing Sheet

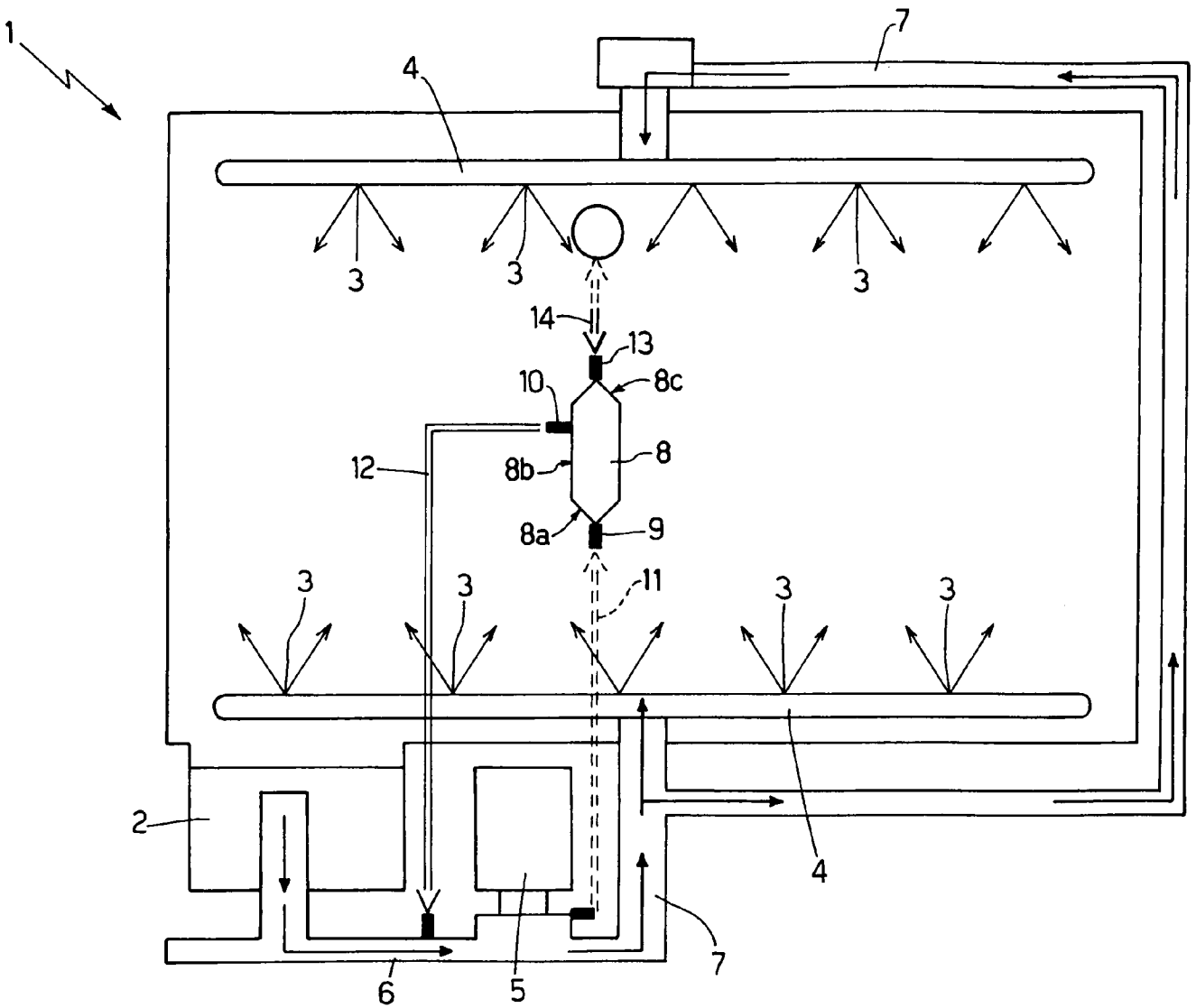
1
2
3
4
5
6
7
8
8a
8b
8c
9
10
11
12
13
14

DISHWASHING MACHINE WITH A GRADUAL-START WASH CYCLE

TECHNICAL FIELD

The present application relates to a dishwashing machine with a gradual-start wash cycle.

BACKGROUND

In the dishwashers used in restaurants, the washing cycle start-up is always a critical moment because of the high water temperature (55-60° C.), which from the washing tank is circulated by the pump nearly instantaneously. Such action can cause both a high vacuum inside the tank and a sudden emission of steam outside the machine.

There are known various systems which are based on the reduction of the number of revolutions of the recirculation pump during the first moments of the washing cycle. Such systems are particularly costly and difficult to apply to high power pumps.

It would be desirable to obtain a dishwashing machine capable of simply and cost-effectively solving the drawbacks of the prior art.

SUMMARY

In one respect, a dishwashing machine includes a wash water tank, a plurality of wash water dispensing nozzles and a recirculation pump adapted to circulate wash water from the tank to the nozzles. The dishwashing machine is characterised in that it includes hydraulic filling means presenting an inlet aperture and an outlet aperture and connected to a first and a second conduit at the apertures; the first and second conduit being connected respectively to a delivery conduit and to a suction conduit of the pump.

The outlet aperture and the inlet aperture may be arranged in a reciprocally offset fashion.

In another aspect, a water dispensing method in a washing cycle of a dishwashing machine involves in sequence a cavitation step in which a circulation pump circulates a mixture of wash water and air, and a full capacity pumping step in which the recirculation pump circulates only wash water.

The cavitation step may comprise an auxiliary pumping operation in which the recirculation pump intakes air from a hydraulic filling means and outputs a wash water/air mixture into the filling container; the auxiliary pumping operation causing a gradual filling of the hydraulic filling means with consequent end of the cavitation step.

BRIEF DESCRIPTION OF THE DRAWING

The description that follows is given by way of a non-limitative example for a better understanding of the present invention with reference to the accompanying drawing which schematically shows one embodiment of a washing station of a dishwashing machine.

DETAILED DESCRIPTION

In the FIGURE it is shown as a whole with numeral 1 a washing station of a dishwashing machine.

The washing station 1 includes a tank 2 for the wash water, a plurality of dispensing nozzles 3 located on upper and lower dispensing arms 4, and a recirculation pump 5, which is connected to the tank 2 via a suction conduit 6 and to the dispensing arms 4 via a delivery conduit 7.

The washing station 1 includes hydraulic filling means consisting of a filling container 8 presenting an inlet aperture 9 located in a bottom portion 8*a*, and an outlet aperture 10 located in a side portion 88*b*. At the inlet 9 and outlet 10 apertures, schematised with a rectangle in the FIGURE, the filling container 8 is connected to a first and a second conduit 11, 12, in turn connected respectively to the delivery conduit 7 and to the suction conduit 6 of the pump 5.

In particular, in the FIGURE, the conduit 11 and the conduit 12 are shown respectively with a broken and solid line with an arrow indicating the direction of circulation of the fluid.

The filling container 8 presents, furthermore, a vent aperture 13, also schematically shown with a rectangle and located in an upper portion 8*c*. The filling container 8, at the vent aperture 13, is connected to a vent conduit 14, which discharges directly into the tank 2.

The vent conduit 14 is shown both with a broken and a solid line and with a double arrow, indicating that in this conduit the fluid can advance in either direction according to the circumstances, as described below.

The filling container 8 and the conduits 11, 12 and 14 can be formed integrally as a unitary body or separately. Furthermore, the machine may include closing systems for the apertures 9, 10 and 13.

The apertures of the filling container 8 and the conduit connected thereto are dimensioned so to realize in the filling container 8 itself the inequality due to which the water flow rate in excess, let out through the vent conduit 14, is lower than the water flow rate from the inlet aperture 9 by a certain value in consequence of which the recirculation pump 5 intakes only water and not an air/water mixture. In this way, it is guaranteed that in the container 8 the suction flow rate is lower than the delivery flow rate, and that it is such, therefore, not to re-establish the cavitation phenomenon during the full capacity pumping step.

In use, the filling container 8 is initially empty of water and is positioned at a height slightly higher than the maximum level that the wash water can reach in the tank 2. With the filling container in this position, the recirculation pump 5 is operated, which, in addition to taking the wash water from the tank 2, intakes the air present in the container 8 through the conduit 12 and, in addition to circulating the water/air mixture in its delivery conduit 7, introduces the air/water mixture into the container 8 through the conduit 11. This action causes the cavitation phenomenon of the wash water and, therefore, a decrease of the pressure at the delivery nozzles 3.

The cavitation step ends after the filling container 8 fills with wash water to a level such that the outlet aperture 10 is covered. From this moment on, the pump 5 takes not air but wash water from the filling container 8 and starts a full capacity pumping step.

From the above, it is apparent how the duration of the cavitation step depends on the volume of the filling container.

The aperture 13 and the vent conduit 14 allow the suction of air during the cavitation step, the discharge of air bubbles present in the pump and, when the pump is not running, the emptying of the filling container 8 at the consequent reinstatement of the circuit.

The described dishwashing machine simply and cost-effectively avoids the sudden circulation of high temperature pressurized water. Furthermore, the adopted solution is applicable to all recirculation pumps without power limitations.

What is claimed is:

1. A dishwashing machine comprising a wash water tank, a plurality of wash water delivery nozzles, and a recirculation pump adapted to circulate wash water from said tank to said nozzles; said dishwashing machine being characterised in that it comprises a filling container having an inlet aperture fluidly connected through a first conduit to a delivery conduit of said pump during delivery of water from said pump to said nozzles such that water from said pump is also delivered to the filling container and an outlet aperture fluidly connected through a second conduit to a suction conduit of said pump during delivery of water from said pump to said nozzles such that fluid is pulled from the filling container by said pump during delivery of water from said pump to said nozzles, said outlet aperture of the filling container is located above said inlet aperture; and a vent aperture located above both said inlet aperture and said outlet aperture and through which air enters the filling container during delivery of water from said pump to said nozzles when water level in the filling container is below said outlet aperture such that entering air is delivered from the filling container through the outlet aperture to said pump resulting in cavitation until water level in the filling container covers the outlet aperture.

2. A machine according to claim 1, characterised in that said inlet aperture and said outlet aperture are located respectively in a bottom portion and a side portion of said filling container.

3. A machine according to claim 1, characterised in that each of said inlet aperture, said outlet aperture and said vent aperture includes a respective closing system.

4. A machine according to claim 3, characterised in that a vent conduit is connected to said filling container at said vent aperture and is adapted to discharge into said tank.

5. A machine according to claim 4, characterised in that said filling container is formed integrally with each of the first conduit, the second conduit and the vent conduit.

6. A machine according to claim 5, characterised in that said inlet, outlet, and vent apertures and said first, second, and vent conduits are dimensioned so that water flow rate out of said filling container is less than or equal to the flow rate entering the filling container through the inlet aperture.

7. A water dispensing method in a washing cycle of a dishwashing machine according to claim 1; said method being characterised in that it comprises in sequence a cavitation step, in which said recirculation pump circulates a mixture of wash water, and air, and a full capacity pumping step, in which said recirculation pump circulates only wash water.

8. A method according to claim 7, characterised in that said cavitation step comprises an auxiliary pumping operation in which said recirculation pump intakes air from said filling container and lets out a mixture of wash water/air into said filling container; said cavitation operation causing a gradual filling of said filling container with consequent end of the cavitation step.

9. A dishwashing machine comprising a wash water tank, a plurality of wash water delivery nozzles, and a recirculation pump adapted to circulate wash water from said tank to said nozzles; said dishwashing machine being characterised in that it comprises a filling container having an inlet aperture connected through a first conduit to a delivery conduit of said pump and an outlet aperture connected through a second conduit to a suction conduit of said pump, said outlet aperture located above said inlet aperture, upon operation of said pump to deliver wash water to said nozzles said pump pulls fluid from the filling container and delivers fluid to the filling container, when a water level in said filling container is below said outlet aperture said pump delivers a mixture of air from said filling container and water from said tank to said nozzles and to said filling container, when water level in said filling container is above said outlet aperture said pump delivers a mixture of water from said filling container and water from said tank to said nozzles and said filling container, and the filling container includes a vent aperture through which fluid can enter said filling container or leave said filling container.

10. The dishwashing machine of claim 9 wherein, when water level in said filling container is above said outlet aperture said pump pulls less water from said filling container than said pump delivers to said filling container and at least some excess water delivered to said filling container leaves said filling container via said vent aperture.

* * * * *